US005959554A

United States Patent [19]

Armstrong et al.

[11] Patent Number: 5,959,554

[45] Date of Patent: Sep. 28, 1999

[54] TRAFFIC CONTROL DEVICE

[75] Inventors: Charles Vincent Armstrong, 64 Prehan Road, Londonberry, BT47 2NT, United Kingdom; James Bonner, Moville, Ireland

[73] Assignee: Charles Vincent Armstrong

[21] Appl. No.: 08/683,714

[22] Filed: Jul. 18, 1996

Related U.S. Application Data

[63] Continuation of application No. PCT/EP95/00180, Jan. 18, 1995.

[30] Foreign Application Priority Data

Jan. 19, 1994 [IE] Ireland ..... S940040

[51] Int. Cl.[6] ..... G08G 1/095

[52] U.S. Cl. ..... 340/908; 340/908.1; 340/907; 116/63 P; 40/435; 40/612

[58] Field of Search ..... 340/908, 908.1, 340/309.15, 907, 480, 484, 481, 482, 483, 486–490; 116/63 P, 63 R, 46, 284, 298, 309, 314, 315; 40/435, 430, 433, 473, 474, 48 P, 490, 534, 612

[56] References Cited

U.S. PATENT DOCUMENTS

| | | | |
|---|---|---|---|
| 3,046,521 | 4/1962 | Cantwell et al. | 340/908.1 |
| 3,867,718 | 2/1975 | Moe | 340/31 R |
| 5,422,638 | 6/1995 | Singer et al. | 340/908.1 |
| 5,493,292 | 2/1996 | Fanslow et al. | 340/908.1 |

FOREIGN PATENT DOCUMENTS

| | | |
|---|---|---|
| 1930596 | 3/1970 | Germany . |
| 1052213 | 12/1966 | United Kingdom . |
| 9218963 | 10/1992 | WIPO . |

*Primary Examiner*—Nina Tong
*Attorney, Agent, or Firm*—Nutter, McClennen & Fish, LLP

[57] ABSTRACT

A traffic control device has a base (14) and a sign (16) rotatably carried by the base. The sign has at least two sides, one of which bears a "GO" indication and the other a "STOP" indication. A radio control means (11) causes a motor in the base to position the sign with the "GO" and "STOP" sides alternately in substantially the same angular position relative to the base.

6 Claims, 13 Drawing Sheets

| Input A | Input B | A | B | C | D |
|---|---|---|---|---|---|
| Low | High | On | On | Off | Off |
| High | Low | Off | Off | On | On |
| High | High | Off | Off | Off | Off |

TRAFFIC CONTROL DEVICE

CROSS REFERENCE TO RELATED APPLICATIONS

This application is a continuation of the International Application PCT/EP95/00180, filed on Jan. 18, 1995.

FIELD OF THE INVENTION

This invention relates to a traffic control device, especially but not exclusively for use for the temporary control of traffic in the vicinity of, for example, roadworks.

DISCLOSURE OF THE INVENTION

According to the present invention there is provided a traffic control device comprising a base, a sign rotatably carried by the base and having at least two sides, one side bearing a "GO" indication and another side bearing a "STOP" indication, a motor on the base coupled to the sign for rotating the latter, and radio control means for causing the motor to position the sign with the said one side and the said other side alternately in substantially the same angular position relative to the base.

By a "GO" indication we mean the word "GO" (in any language) and/or a green colour and/or any other symbol, word or colour which is generally recognised as permitting oncoming traffic to pass. Similarly, by a "STOP" indication we mean the word "STOP" (in any language) and/or a red colour and/or any other symbol, word or colour which is generally recognised as requiring oncoming traffic to stop.

In the embodiment the sign consists essentially of a single panel bearing on opposite sides the English words GO and STOP on green and red backgrounds respectively, as the GO and STOP indications. However, one could use light boxes as either one or both of the GO ad STOP indications, and these could be mounted on the panel or above it or (where both the STOP and GO indications are implemented as light boxes) replace it, as described hereinafter. Accordingly, the expression "sign" is to be interpreted broadly to include one or more devices which in combination provide STOP and GO indications as aforesaid.

BRIEF DESCRIPTION OF THE DRAWINGS

Embodiments of the invention will now be described, by way of example, with reference to the accompanying drawings, in which.

DESCRIPTION OF THE PREFERRED EMBODIMENTS

Figure 1:
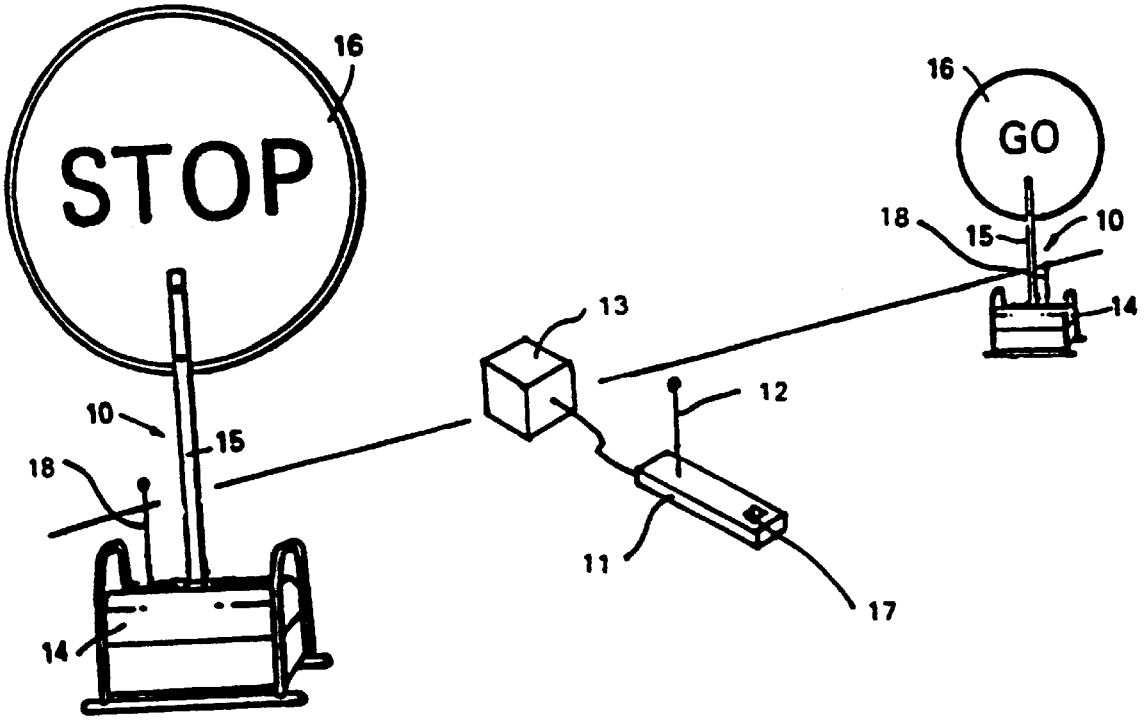
FIG. 1 shows the externally visible components of a traffic control system using two traffic control devices according to a first embodiment of the invention.

Referring first to the embodiment of FIGS. 1 to 8, and initially to FIG. 1, a temporary traffic control system comprises two substantially identical traffic control devices 10 and a remote handset 11 common to both devices. In FIG. 1 the two devices are assumed to be positioned along the side of a road at the opposite ends of a roadworks.

Figure 4:
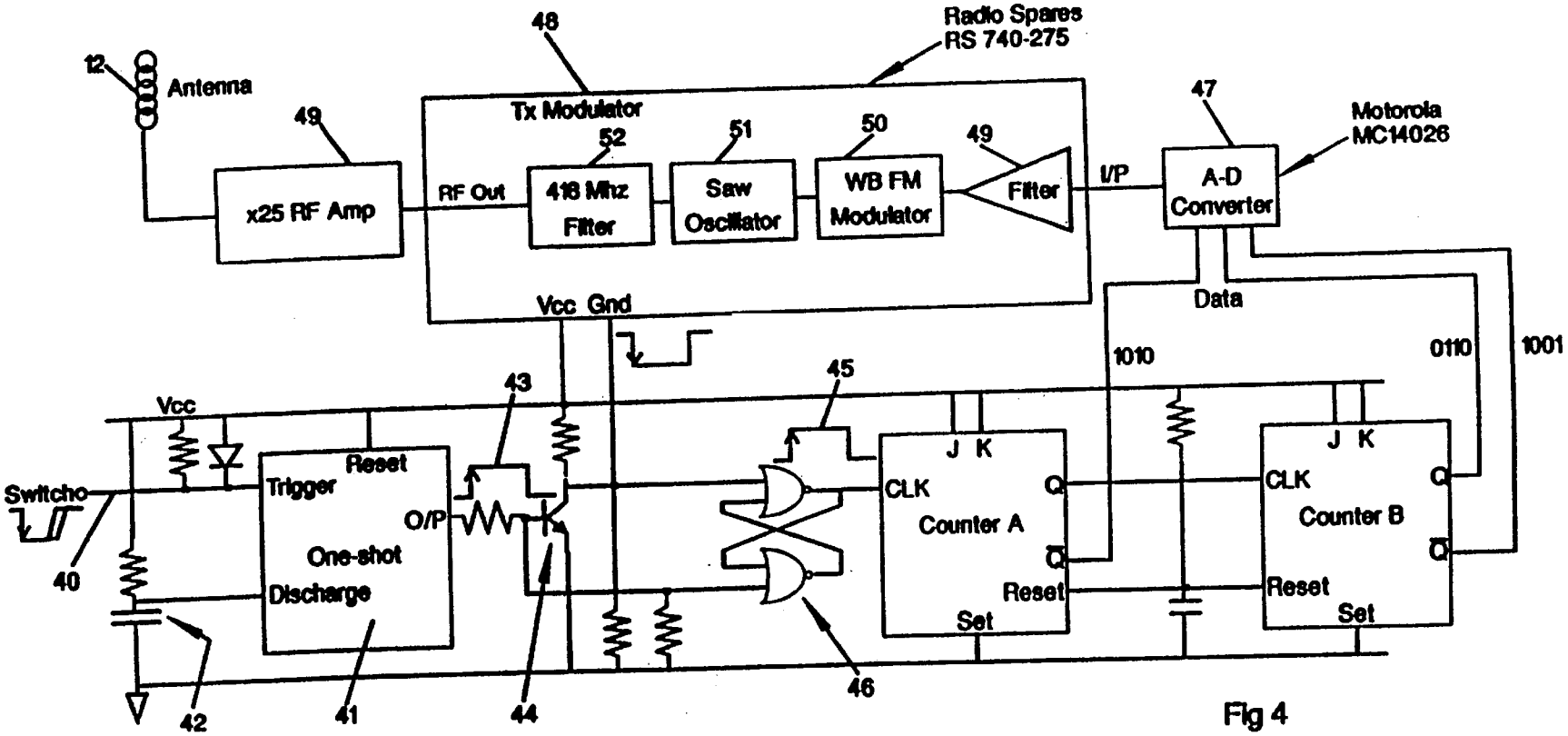
FIG. 4 is a block diagram of the intern transmitter circuitry of the handset which controls the two traffic control devices of FIG. 1.

The handset 11 has an antenna 12 for transmitting control signals by radio to each device 10, and is powered by ten Nicad rechargeable batteries wired in series to supply 12 volts to the handset circuitry (FIG. 4). The batteries are encapsulated in a sealed box 13 and are connected to the handset 11 via a waterproof 3-pin connector.

Each device 10 has a base 14, and a post 15 extends substantially vertically upwardly from the base and is rotatable about its own axis. A sign in the form of a flat circular panel 16 is carried by the post 15, and this has on one side the work "GO" on a green background and on the opposite side the work "STOP" on a red background. Each device also has a respective antenna 18 mounted on the base 14 for receiving the control signals transmitted by the handset 11.

As will be described, a motor on the base 14 is coupled to the post 15 for rotating the latter, and a control circuit responsive to successive control signals received from the handset 11 (generated in response to successive pushes on a handset control button 17) causes the motor to rotate the post by 180 degrees in response to each control signal to position the sign in alternate angular positions 180 degrees apart. The handset 11 is adapted to issue the control signals in pairs alternately to the devices 10, so that a complete control cycle consists of four consecutive control signals from the handset 11.

In the four-signal control cycle, the first control signal rotates one of the signs, say the left sign as shown in FIG. 1, by 180 degrees. The next control signal then rotates the same sign through a further 180 degrees so that it returns to its original position. Then the next two control signals similarly cause the other sign (the right sign in FIG. 1) to rotate through two successive 180 degree turns, returning it to the original position. This cycle repeats for each successive set of four control signals.

At this point it should be explained that each device 10 has a STOP position and a GO position. The STOP position is when the STOP side of the sign 16 is facing a particular direction relative to the base 14, for example when the antenna 18 is on the left of the post 15 when the STOP side of the sign 16 is viewed, and the GO position is when the antenna 18 is on the right of the post 15 when the STOP side of the sign is viewed. Thus in FIG. 1 both the signs are at the STOP position.

Assuming the FIG. 1 situation to be the starting positions for the signs, i.e. both the signs are in their STOP positions with the STOP sides of the two signs 16 facing away from one another at opposite ends of the roadworks, the first control signal will turn one of the signs to the GO position, the second control signal will then turn the same sign back to the STOP position, the third control signal will turn the other sign to the GO position ad the fourth control signal will turn the same sign back to the STOP position.

This placement of the devices 10 prior to operation of the system is essential if there are not to be two GO signs simultaneously showing to oncoming traffic at opposite ends of the roadwork. At this point it should be mentioned that each device 10 is capable of independent operation by the handset to permit a single such device 10 to be used in cases where the short length of roadworks does not warrant the use of two signs. Naturally in such a case it does not matter which way round the device is placed because, of course, there can never be a GO sign showing simultaneously in the two directions of traffic flow. The use of the device 10 as a single independent unit will be described later.

Figure 2:
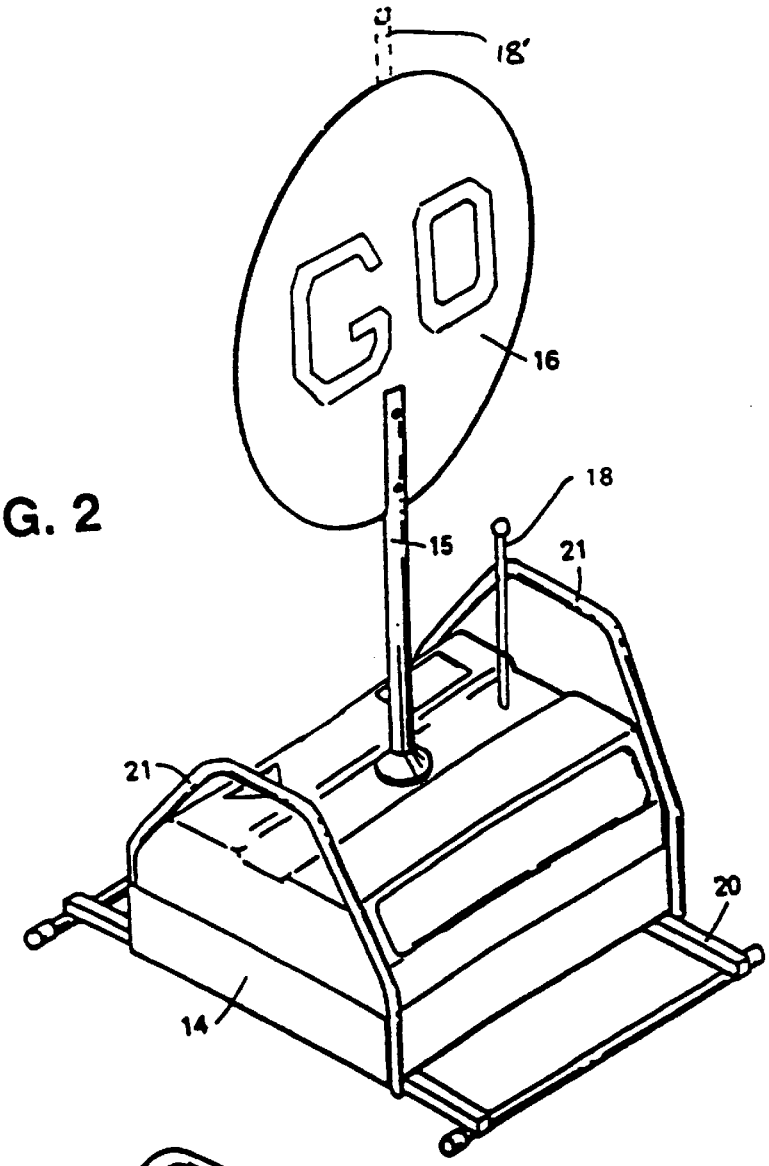
FIG. 2 is a perspective view of one of the two traffic control devices shown in FIG. 1 (both being identical except as otherwise specified herein)
Figure 3:
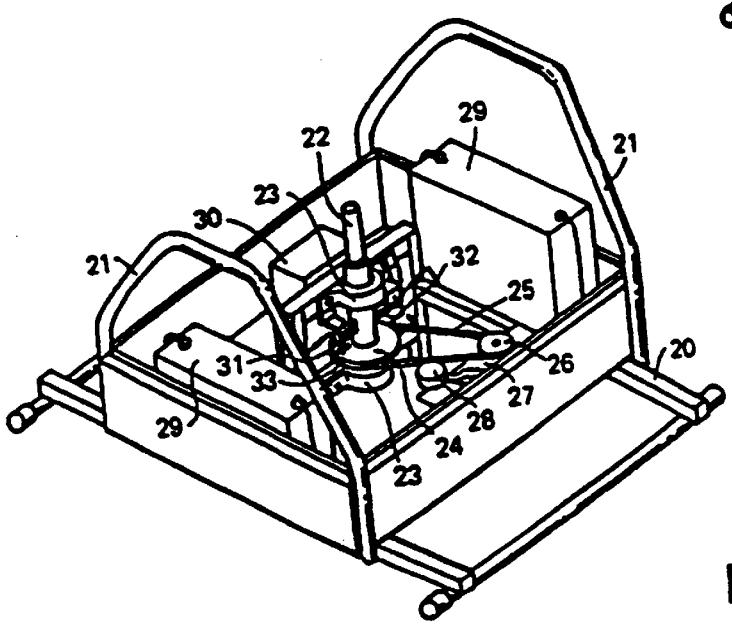
FIG. 3 shows the traffic control device of FIG. 2 with the base cover removed, and also the post and sign removed.

Turning now to FIGS. 2 and 3, each device 10 comprises a base frame 20 with carrying handles 21. A shaft 22 is mounted vertically in the base frame 20, in bearings 23, for rotation about its own axis. There is a pulley 24 fixed to the shaft 22, and the pulley 24 is coupled by a drive belt 25 to a motor pulley 26. The motor pulley 26 is connected to the drive shaft of an electric motor 27 mounted on the base frame 20. The belt 25 has a tensioner 28. The power for the electric motor 27 is derived from two 12-volt batteries 29 connected in parallel. If desired, solar panels (not shown) may be provided on the base 14 to charge the batteries 29 in ambient light conditions, to provide the device 10 with extended operational use between battery re-charge cycles. The base further has a control box 30 containing control circuitry (FIGS. 5 and 6) for the device 10.

Just above and close to the upper surface of the pulley 24 there are fixed two position sensors in the form of reed switches 31 and 32 respectively. These are disposed 180 degrees apart around the axis of the shaft 27. A small permanent magnet 33 is fixed to the upper surface of the pulley 24. Thus, as the shaft 27, and hence the post 15, rotates, the magnet 33 comes into close proximity with alternate reed switches 31 and 32 every 180 degree rotation of the post. The magnet 33 causes each reed switch 31 and 32 to close when it comes into close proximity with it.

As will be described, it is the closure of a corresponding reed switch which terminates each 180 degree rotation of the shaft 27, rotation of the shaft 27 being started in response to a control signal from the handset 11 and being automatically halted when the magnet 33 comes into close proximity with the next reed switch 31 or 32.

Thus the STOP position of the device 10 is defined by the angular position of the shaft 27 when the magnet 33 is closely adjacent a particular one of the two reed switches 31 or 32, and the GO position is defined when the magnet 33 is closely adjacent the other of the two reed switches. In this embodiment it will be assumed that the reed switch 31 is that which defines the STOP position of the device, and the reed switch 32 is that which defines the GO position of the device.

As will be seen from the following description, when moving from the STOP position to the GO position and then back to the STOP position, each sign does not make a full 360 degree rotation. Rather, each sign rotates in one direction from the STOP position to the GO position and then rotates back in the opposite direction to return to the STOP position. Thus each sign actually rotates back and forth through the same 180 degree angle. This will permit the antenna 18 to be located at an alternative location on the top of the sign 16 rather than on the base 14, as sohwn at 18' in broken lines in FIG. 2, since the wire (not shown) necessary to connect the antenna to the circuitry in the base 14 would otherwise become wrapped around the post 15. Naturally, placing the antenna at the top of the sign will increase the effective range of the radio signal.

For ease of transportation the pole 15 is removably mounted on the shaft 27, and the sign 16 is itself removably mounted on the pole 15. However, bearing in mind the need to establish unambiguous STOP and GO positions for the device, the pole 15 is only able to be fitted to the shaft 27 in one angular position, and likewise the sign 16 is only capable of being fitted to the pole 15 in one angular position.

Figure 6:
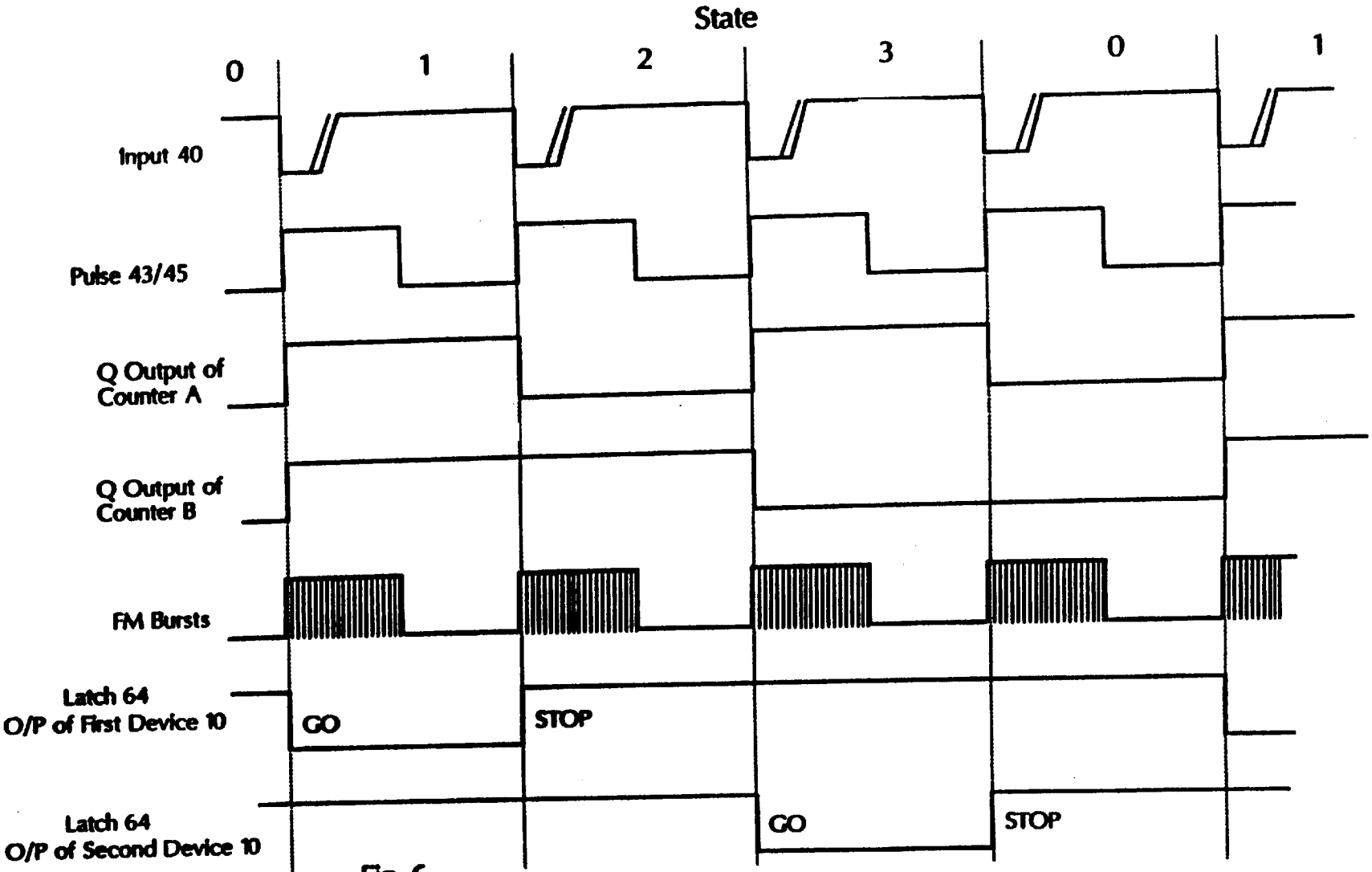
FIG. 6 is a timing diagram to an arbitrary scale illustrating the operation of the circuitry of FIGS. 4 and 5, FIGS. 7A and 7B show the motor control circuit of each traffic control device of FIG. 1.

Turning now to FIG. 4, and with reference also to FIG. 6, when the control button 17 (FIG. 1) is pressed by an operator, the input 40 of the control circuit is grounded, providing a negative-going edge at the trigger input of a one-shot multi-vibrator 41. This causes the output O/P of the latter to go high for a period determined by the resistor/capacitor combination 42. This period is designed to be several seconds, to ensure that a given sign completes its turn to the new position before a subsequent control signal can be issued by the handset. For example, a sign currently in the GO position must complete its rotation to the STOP position before a subsequent control signal can start to turn the other sign to the GO position.

The positive-going pulse 43 thus produced at the output of the one-shot 41 turns a transistor 44 on for the duration of such pulse. This pulls the collector of the transistor 44 low and provides a positive-going pulse 45 at the clock input CLK of a first counter A via cross-coupled NOR gates 46.

The pulse 45 has the same duration as the pulse 43. The effect is equivalent to connecting the output O/P of the one-shot 41 directly to the clock input of the counter A, but the transistor 44 and NOR gates 46 constitute a de-bouncing circuit which buffers instability in the output of the one-shot 41. The pulses 43 and 45 are shown in the second line of FIG. 6.

The counter A is positive-edge triggered, so that the leading edge of the pulse 45 causes the Q output of the counter A to go high ad correspondingly the Q bar output to go low. The Q output of the counter A is connected to the clock input of a second positive-edge triggered counter B, so that the Q output of the counter B goes high and correspondingly the Q bar output goes low.

At this point it should be explained that the initial states of the counters A and B are as shown in the first line of the truth table shown in FIG. 4B, that is, in the zero or reset state. In the truth table, Qa bar refers to the Q bar output of the counter A, Qb bar refers to the Q bar output of the counter B, and Qb refers to the Q output of the counter B. Thus, the occurrence of the pulse 43, and hence the pulse 45, switches the counters to the states shown in the second line of the truth table, state 1.

The counters remain in state 1 until the next time the button 17 is pressed, whereupon the leading edge of the corresponding pulse 45 causes the Q output of the counter A to go low and corresponding the Q bar output to go high. However, the negative-going edge at the Q output of the counter A does not change the state of the counter B because it is positive-edge triggered. At this point the counters are in state 2.

The next pulse 45, occurring on the third push of the button 17, causes the Q output of the counter A to go high and the Q bar output to go low, and this time the positive-going edge at the Q output of the counter A causes the Q output of the counter B to go low and correspondingly the Q bar output to go high. This is state 3 shown in the truth table.

A fourth push of the button 17 causes the Q output of the counter A to go low again and the Q bar output to go high. However, the state of the counter B is not changed by the negative-going edge at the output of the counter A. Thus the counters are returned to state 0 and thereafter the cycle described above repeats for further pushes of the button 17 so that the counters A and B will cycle repeatedly through states 1, 2, 3, 0 so long as the button 17 is operated. The third and fourth lines of FIG. 6 show the Q outputs of the counters for the states 0–3.

At this point it should be noted that although FIG. 6 shows states 0–3 having the same duration, in general they will have different durations depending upon the instant at which the button 17 is pushed.

The Qa bar, Qb bar and Qb outputs of the two counters are applied in parallel to the inputs of an analog to digital (A–D) converter 47. This may be a Motorola A–D converter of type MC 14026. The output of the A–D converter 47 is an analog signal whose amplitude is proportional to the binary value of the 3-bit input, and will be different for each state 0–3 of the counters.

The analog signal is applied as input to a transmission (Tx) modulator 48 which essentially comprises an input filter 49, a wide band FM modulator 50, a SAW oscillator 51 and a 418 Mhz output filter 52. The modulator 48 may be obtained as a standard off-the-shelf item from Radio Spares Components Limited of PO Box 99, Corby, Northants, England under catalog number RS 740-275. The output of the Tx modulator 48 is a 418 MHz frequency-modulated (FM) signal wherein the degree or depth of modulation at any instant is proportional to the amplitude of the analog signal from the A–D converter 47.

At this point it should be explained that the Tx modulator 48 is not in continuous operation. As indicated in FIG. 4, the ground terminal for the Tx modulator power supply is connected not to circuit ground but to the collector of the transistor 44. This means that the ground terminal is normally disconnected from circuit ground because the transistor 44 is normally off, and the Tx modulator is therefore not powered. However, during the occurrence of a pulse 43 the transistor 44 is turned on. This connects the ground terminal of the Tx modulator to circuit ground so completing the power supply circuit for the Tx modulator. Thus the Tx modulator is only powered for a few seconds after each time the button 17 is pressed, for the duration of each pulse 43. This conserves the battery power.

The result is that each time the button 17 is pressed the Tx modulator 48 provides a signal burst lasting for the duration of the pulse 43, the depth of modulation of the burst being dependent upon the state of the counters A and B. Thus, each time we cycle through the four states 1, 2, 3, 0 of the counters A and B as previously described, the Tx modulator outputs a set of four bursts, one for each state, each burst occurring at the beginning of the respective state and having a different depth of modulation. This is shown in the fifth line of FIG. 6. As will be seen, these four bursts constitute the four signals of the four-signal control cycle referred to earlier. The FM bursts are amplified in an RF amplifier 49 and supplied to the antenna 12 for transmission to the traffic control devices 10.

Figure 5:
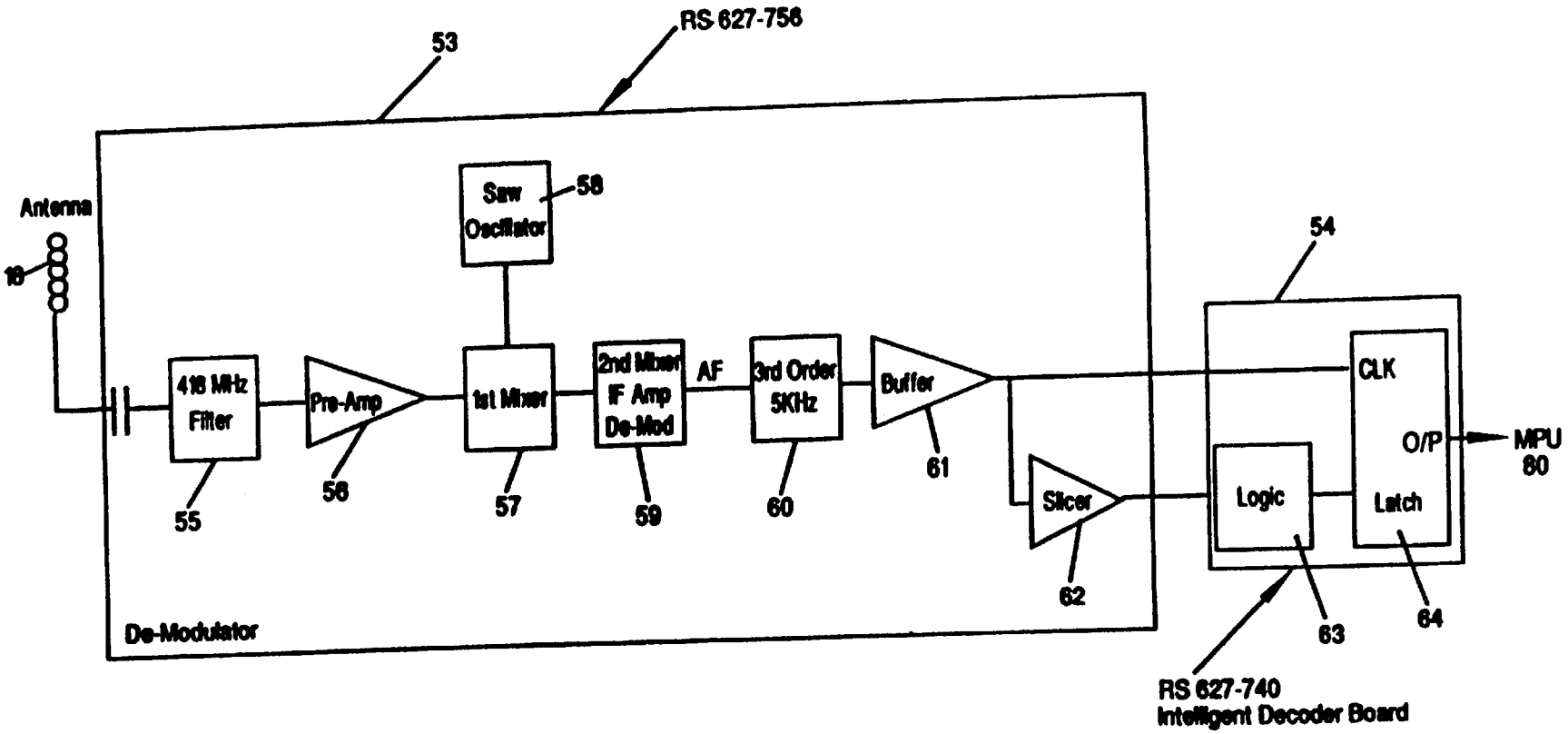
FIG. 5 is a block diagram of the internal receiver and decoder circuitry of each traffic control device of FIG. 1.

Turning now to FIG. 5, the signal bursts transmitted by the handset are picked up by the antenna 18 on each device 10 and fed to an FM de-modulator 53 connected to a microprocessor-based intelligent decoder board 54. In the de-modulator 53 the received signal is supplied through a 418 Mhz input filter 55 and a pre-amplifier 56 to a first mixer 57 where the signal is mixed with that from a SAW oscillator 58. The IF frequency thus produced is amplified and de-modulated in a second mixer 59 to provide an audio frequency output. The latter is applied via a 3rd Order 5 Khz filter 60 and a buffer 61 to a slicer 62 whose output is connected to a logic circuit 63 on the intelligent decoder board 54. The output of the buffer 61 is also supplied directly to the clock input CLK of a latch 64 on the board 54. The de-modulator 53 and the intelligent decoder board 54 may also be obtained as standard off-the-shelf items from Radio Spares Components Limited, under catalog numbers RS 627-756 and RS 627-740 respectively. It will be understood that only sufficient of the intelligent decoder board 54 is shown to explain its operation in this embodiment.

The slicer 62 has a one-bit digitised output which provides a pulse train to the logic circuit 63 each time an FM signal burst is received and decoded by the de-modulator 53. The duration of the pulse train is substantially the same as that of the received FM burst and the pulse repetition frequency is proportional to the modulation depth of the particular burst which in turn is dependent upon the current state of the counters A and B.

Thus, each time the push button 17 is pressed on the handset 11 the slicer 62 in each device 10 will (assuming the device 10 is in radio contact with the handset) provide a pulse train to the logic circuit 63, the pulse train having a duration substantially the same as that of the pulse 43 (FIG. 4) and having a pulse repetition rate proportional to the current state of the counters A and B.

It will be recalled that the handset 11 issues the control signals in pairs alternately to the devices 10. Therefore, since the demodulator 53 in each device 10 detects all four FM bursts in a four-signal control cycle, the intelligent decoder board 54 is programmed to select (recognise), on the basis of the pulse repetition rate of the corresponding pulse trains at the slicer 62 output, two of those four signals as the two which control that particular device. To this end the board 54 has two channel buttons (not shown). If a particular one of these is pressed while a signal of a particular pulse repetition rate is applied to the logic circuitry 63 the latter recognises a pulse train having that repetition rate as a set signal for the latch 64. Then, if the other one of the channel buttons is pressed while a signal of a different pulse repetition rate is applied to the logic circuitry 63 the latter recognises a pulse train having that different repetition rate as a reset signal for the latch 64.

Accordingly, the intelligent decoder board 54 in one of the devices 10 is programmed to recognise the pulse train frequencies corresponding to the first and second FM signal bursts in a four-signal control cycle as its set and reset control signals respectively, and the intelligent decoder board 54 in the other device 10 is programmed to recognise the pulse train frequencies corresponding to the third and fourth FM signal bursts in a four-signal control cycle as its set and reset control signals respectively.

In response to a set signal the corresponding output O/P of the latch 64 will go low, and in response to a reset signal the output O/P will go high. Therefore, in a four-signal control cycle the first time the handset button 17 is pressed the output of the latch 64 in one of the devices 10 will go low, the second time the handset button 17 is pressed the output of the latch 64 in the same device 10 will go high, the third time the handset button 17 is pressed the output of the latch 64 in the other of the devices 10 will go low, and the fourth time the handset button 17 is pressed the output of the latch 64 in that other device 10 will go high. This is shown in the sixth and seventh lines of FIG. 6.

As indicated in FIG. 6, it is desired that the negative-going edge at the output of each latch 64 constitute an instruction for turning the respective sign to the GO position, and that the positive-going edge at the latch output constitute an instruction for turning the sign back to the STOP position. This is achieved by the motor control circuit of FIGS. 7A and 7B which monitors the signal at the output of the respective latch 64.

Figure 7A:
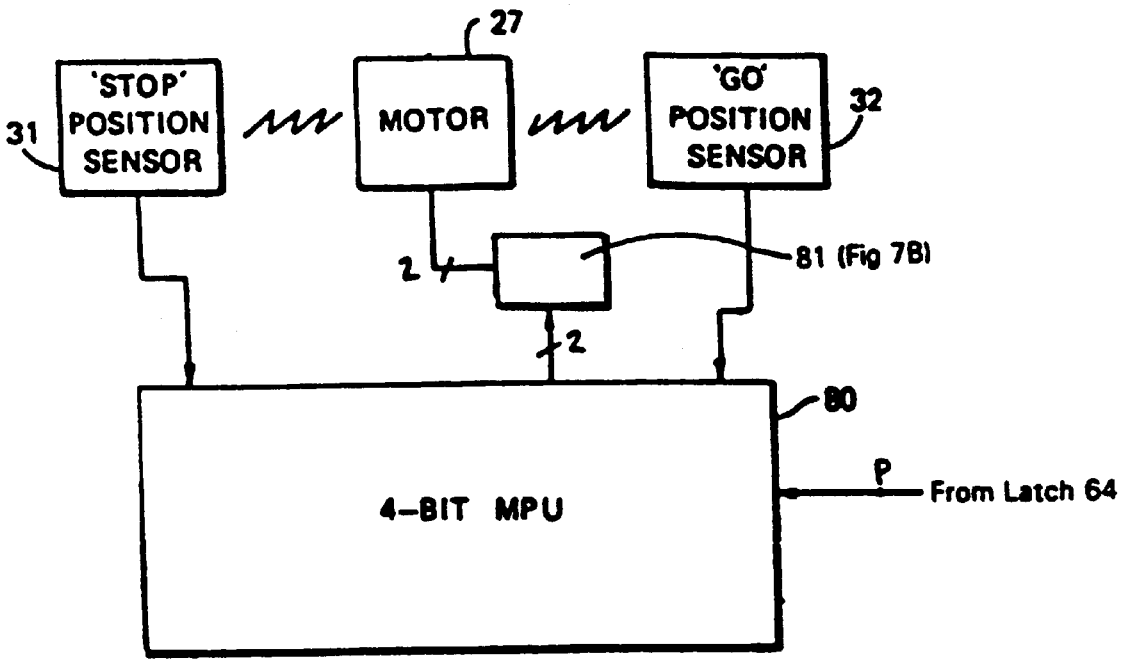
Figure 7B:
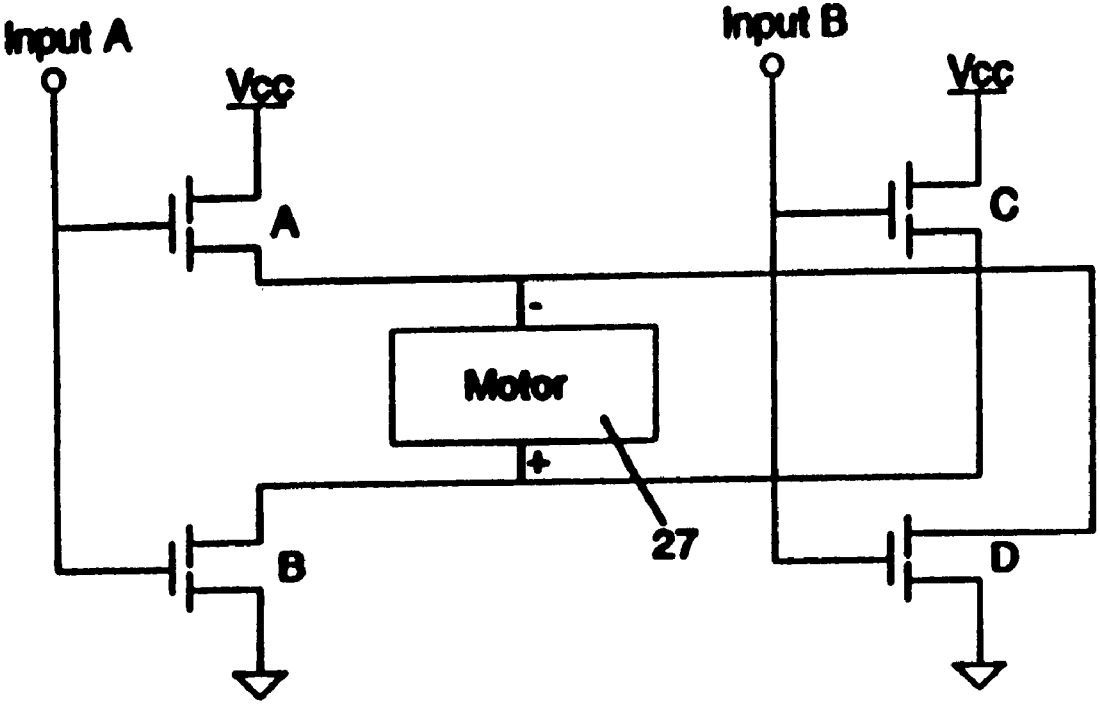

The motor control circuit is based upon a 4-bit microprocessor (MPU) 80. This has an input connected to the output of the latch 64 and also has inputs from the reed switches 31 and 32. It has two outputs connected to inputs A and B respectively of a motor switching circuit 81 (FIG. 7B).

Figure 8:
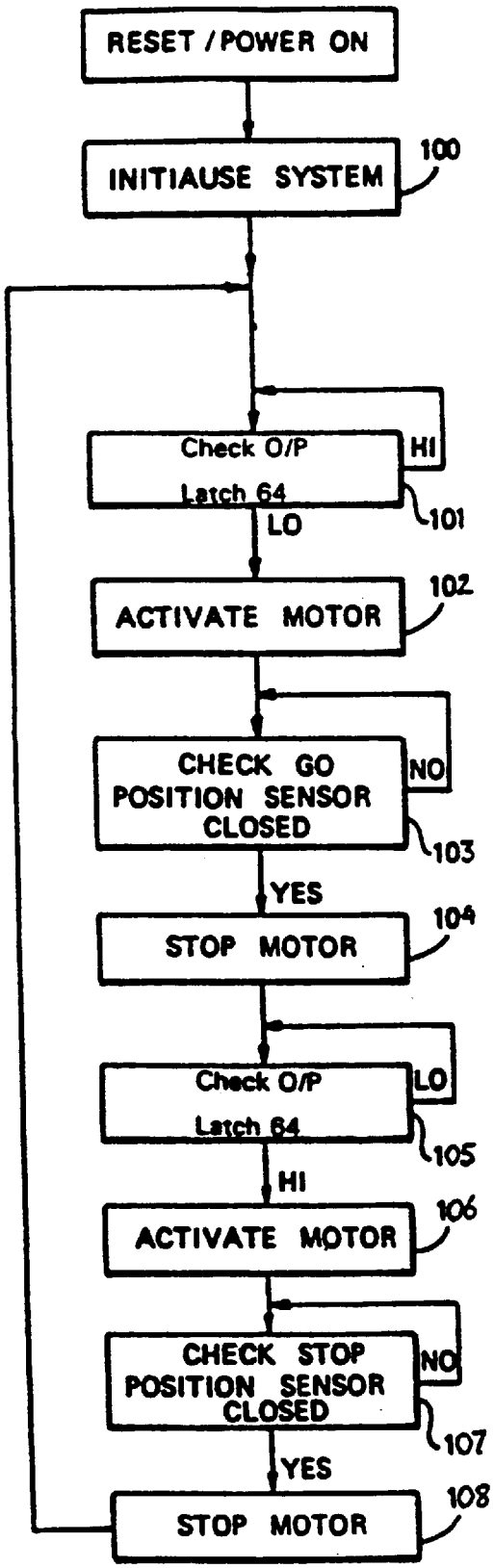
FIG. 8 is a flow diagram of the main program steps executed by the microprocessor in the motor control circuit of FIG. 7.

Turning now to FIG. 8, the programmed operation of the MPU 80 in each traffic control device 10 when the latter is powered on will now be described.

First, the device 10 is initialised, step 100, by ensuring the device is in state zero (FIG. 6) and by ensuring that the associated sign is in the STOP position. This it does by examining the reed switch 31 for being closed. At this point, if the device is not in the STOP position, the device may shut off, but preferably closes the motor control switch 86 until it senses that the reed switch 31 has become closed.

Next the MPU 80 moves to step 101, where it monitors the output of the latch 64 for going low, in order to identify a negative-going edge. When the MPU 80 detects the latch output going low, it starts the motor 27 (step 102) by supplying a signal on input A (FIG. 7B) to turn on field effect transistors (FETs) A and B. This places battery power across the motor 27 so that the latter starts to rotate the sign 16.

Now the MPU 80 monitors the reed switch 32 for closing, step 103. When the MPU 80 detects the reed switch 32 closed it stops the motor 27, step 104, by turning off the FETs A and B. Now the device 10 is in its GO position.

The MPU 80 now moves to step 105, where it monitors the output of the latch 64 for going high, in order to identify a positive-going edge. When the MPU 80 detects the latch output going high, it starts the motor 27 again (step 106) by supplying a signal on input B (FIG. 7B) to turn on FETs C and D. This places battery power across the motor 27 so that the latter starts to rotate the sign 16. However, the closure of FETs C and D in this case means that the battery power is connected with reverse polarity across the motor as compared to step 102, so the sign rotates back in the opposite direction to its earlier rotation following step 102.

As before, the MPU 80 monitors the reed switch 31 for closing, step 107.

When the MPU 80 detects the reed switch 31 closed it stops the motor 27 by turning off the FETs C and D, step 108. Now the device 10 has returned to its STOP position.

Since each device 10 has its intelligent decoder board 54 recognise a different pair of consecutive FM bursts as "turn to GO" and "turn to STOP" instructions, each device will turn to its GO position and back to its STOP position while the other device waits in its STOP position.

The above has described the devices 10 used in pairs in a traffic control system. However, a single such device 10 may be used where appropriate, as mentioned above. The handset for such a single device 10 operating on its own could be the same as described above, in which case two of the four control signals in the four-signal control cycle would be redundant. Alternatively, it would be possible to design the handset to provide just a pair of control signals in each control signal cycle, which turn the sign to Go and STOP alternatively.

The foregoing has described a system wherein the turning of the signs is performed under manual control. However, it is possible to use an automatic timer, as will now be described with reference to FIGS. 9 to 11.

Figure 9:
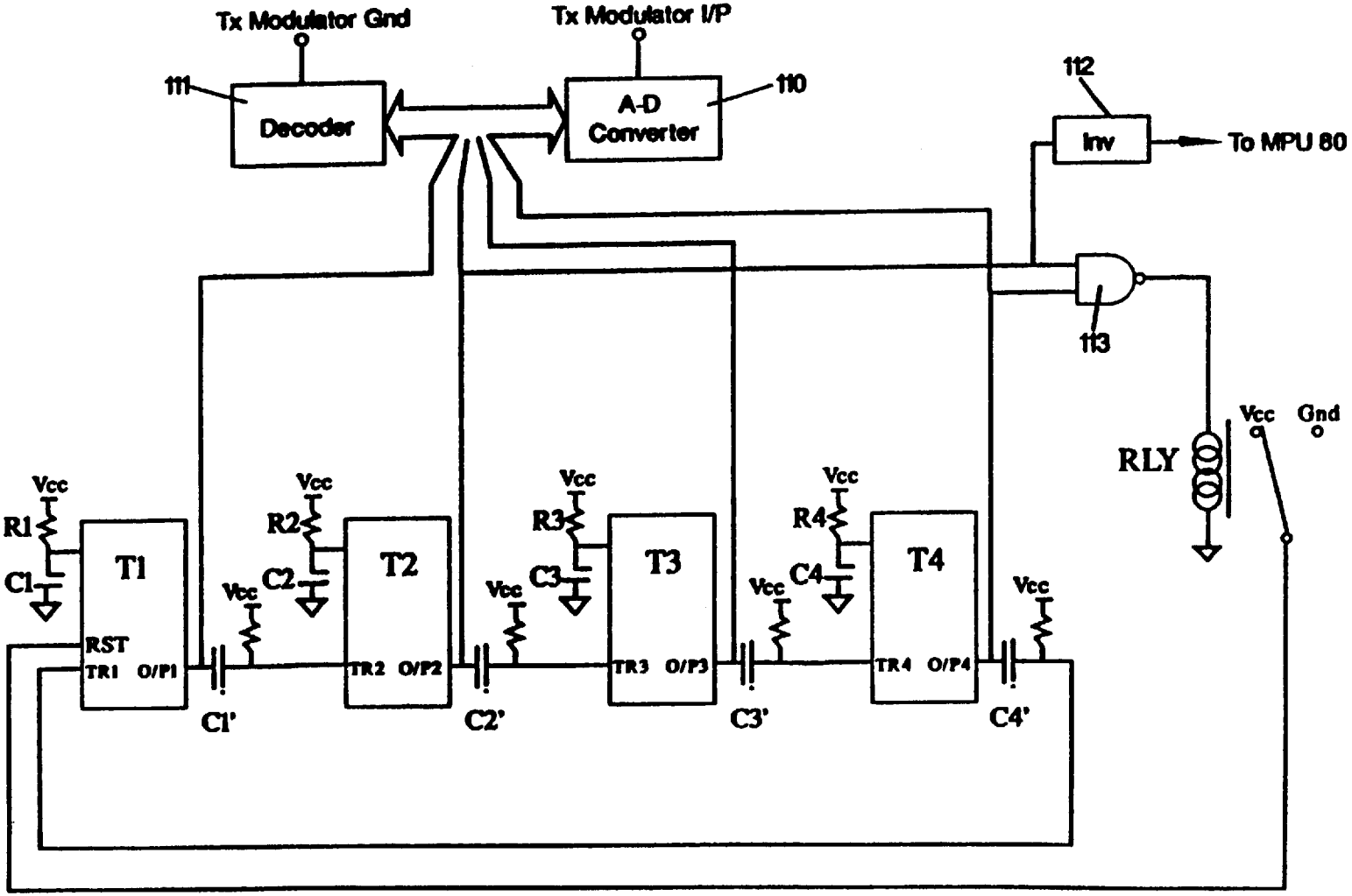
FIG. 9 is a block diagram of an automatic timer circuit which can be used to control the traffic control devices shown in FIG. 1 according to a second embodiment of the invention.
Figure 10:
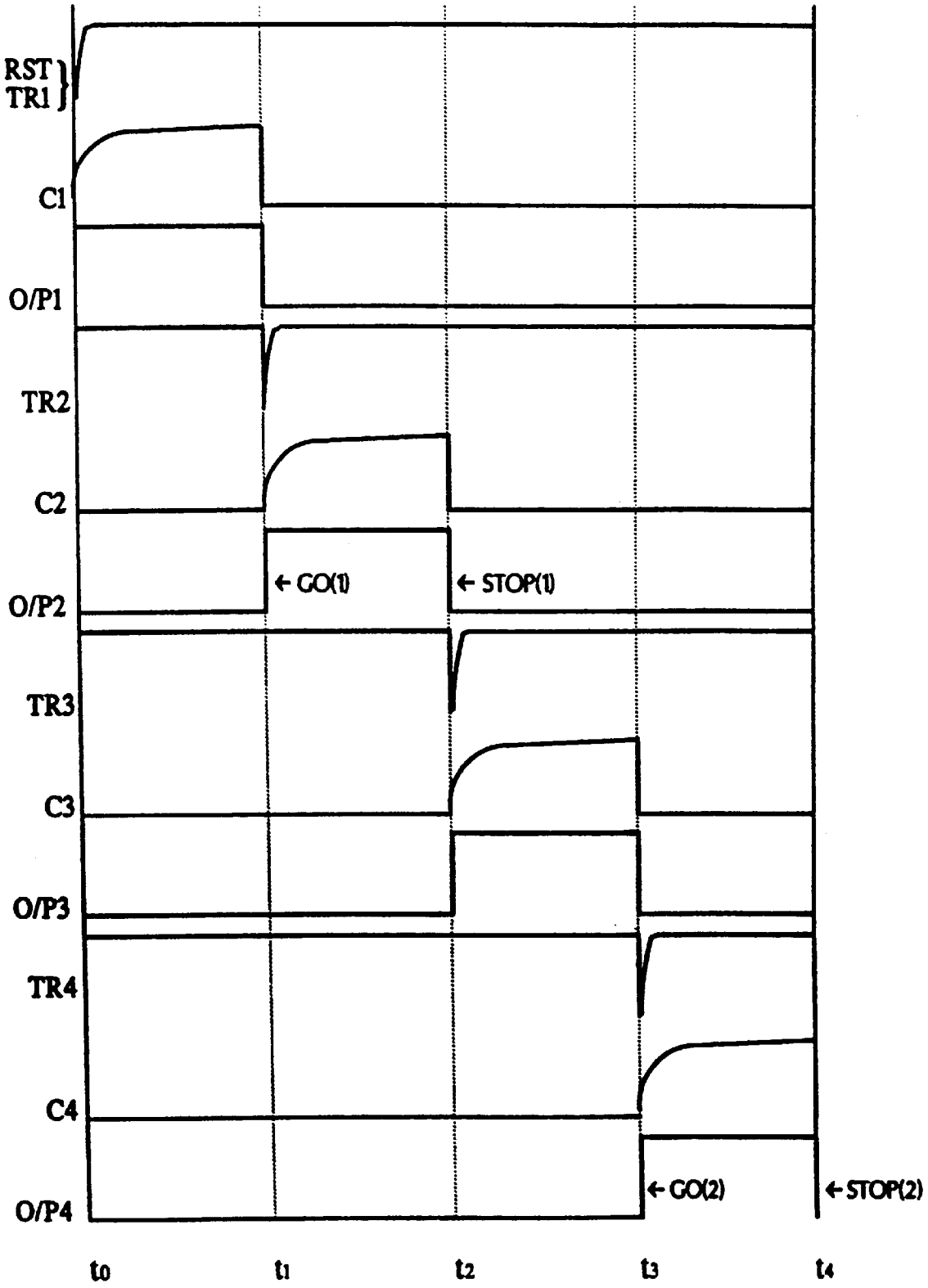
FIG. 10 is a timing digram showing the operation of the circuit of FIG. 9.

FIG. 9 is a block diagram of an automatic timer circuit which can be used to control the system shown in FIGS. 1 to 3 and 5 to 8 in place of the remote handset 11 whose circuit is shown in FIG. 4. FIG. 10 is a timing diagram showing the operation of the circuit of FIG. 9. Each line of FIG. 10 shows the signal occurring at the similarly referenced point in FIG. 9.

The automatic timer circuit comprises four so-called 555 timer chips T1 to T4 having respective trigger inputs TR1 to TR4 and respective outputs O/P1 to O/P4. The timers T1 to T4 are connected in series, with a feedback connection from the last timer T4 to the first timer T1. Thus the outputs O/P1 to O/P3 of the timers T1 to T3 are connected respectively to the trigger inputs TR2 to TR4 of the timers T2 to T4 via respective coupling capacitors C1' to C3', and the output O/P4 of the last timer T4 is connected to the trigger input TR1 of the first timer T1 via a coupling capacitor C4'. A respective RC circuit R1,C1 to R4,C4 determines the time constant of each timer T1 to T4. It will be appreciated that instead of using four 555 timer chips the circuit may be implemented using two 556 timer chips, since a 556 timer chip contains within it two 555 timer circuits.

At time t0, FIG. 10, the timer T1 is reset by a negative pulse applied to the reset input RST, which causes the voltage on the output O/P1 of the timer T1 to go high. The capacitor C1 of the associated RC circuit R1,C1 charges up until it reaches the threshold voltage of the timer T1, during which time the voltage on the output O/P1 of the timer T1 remains high. At time t1 the capacitor C1 reaches the threshold voltage at which point the voltage at O/P1 goes low.

The high-low transition occurring at O/P1 at time t1 produces, via the coupling capacitor C1', a negative-going pulse at the trigger input TR2 of the timer T2. This causes the voltage on the output O/P2 of the timer T2 to go high. Similar to the case of the timer T1, the capacitor C2 of the RC circuit R2,C2 associated with the timer T2 charges up until it reaches the threshold voltage of the timer T2, during which time the voltage on the output O/P2 of the timer T2 remains high. At time t2 the capacitor C2 reaches the threshold voltage at which point the voltage at O/P2 goes low.

The high-low transition occurring at O/P2 at time t2 produces, via the coupling capacitor C2', a negative-going pulse at the trigger input TR3 of the timer T3, whereupon the previously described sequence of events for timer T2 now occurs for timer T3, as shown in FIG. 8(*b*), culminating at time t3 in a negative-going pulse at the trigger input TR4 of the timer T4. This in turn triggers the timer T4 and this too now goes through the described sequence ending at time t4 in a negative-going pulse appearing at the right hand side of the capacitor C4'. This pulse is fed back to the trigger input TR1 of the timer T1, so that the cycle repeats again as from time t0.

As indicated on FIG. 10, it is required that the positive- and negative-going edges at the output of the timer T2 respectively constitute "turn to GO" and "turn to STOP" instructions for a first of the devices 10 and that the positive- and negative-going edges at the output of the timer T4 respectively constitute "turn to GO" and "turn to STOP" instructions for the second of the devices 10.

The outputs O/P1 to O/P4 of the timers T1 to T4 are supplied as a 4-bit word to an A–D convener 110. The latter provides an analog signal as output whose amplitude is proportional to the value of the 4-bit word. The analog signal is provided as input to a Tx modulator 48 the same as that described with reference to FIG. 4. The output of the Tx modulator is an FM signal whose depth of modulation is proportional to the value of the analog signal. This signal is amplified in the RF amplifier 49 and supplied to the antenna 12.

Because it is only necessary to transmit to the devices 10 during the periods t1 to t2 and t3 to t4, a decoder 111 identifies these periods from the value of the 4-bit word and connects the Tx modulator ground terminal to circuit ground only during such periods. This saves battery power.

Thus the output of the automatic timer is an intermittent FM signal consisting of signal periods at times t1 to t2 and t3 to t4 and non-signal periods at times t0 to t1 and t2 to t3, the depth of modulation of the signal during the signal periods alternating between two values from one signal period to the next as determined by the value of the current 4-bit word applied to the A–D converter 110. Accordingly, at the output of the slicer 62 in each device 10 (FIG. 5) there will be provided intermittent pulse trains whose pulse repetition frequency alternates between two values from one pulse train to the next.

It will be observed that whereas in the first embodiment the "turn to GO" and "turn to STOP" commands were given by separate FM bursts (FIG. 6), in the present case they are given by the start and end respectively of each pulse main. That is to say, the start and finish of each alternate pulse train constitute "turn to GO" and "turn to STOP" commands respectively for one device 10 and the start and finish of each intervening pulse train constitute "turn to GO" and "turn to STOP" commands respectively for the other device 10.

Each device 10 has its intelligent decoder board 54 programmed, as described above, to recognise a different one of the pulse repetition frequencies as its set signal and to ignore the other pulse repetition frequency. Since a reset frequency for each device is not established, the output of the latch 64 cannot be used to control the rotation of the sign since, once set, the latch will not be set thereafter.

However, the intelligent decoder board 54 has a transistor output (not shown) which goes low during the occurrence of a "set" pulse train at the input of the logic circuit 63. Such output can be monitored by the MPU 80 as previously described to determine when it goes low, and hence when the associated sign is to turn to the GO position, and when it goes high, and hence when the associated sign is to turn to the STOP position.

The timing of the GO/STOP cycle for the devices 10 is determined by the component values in the RC circuits R1,C1 to R4,C4. Clearly it is desirable to permit adjustment of the timing, and this is readily accomplished by providing each of R1 to R4 as a potentiometer.

For safety reasons the outputs O/P2 and O/P4 from the timers T2 and T4 are respectively connected to the inputs of a NAND gate 113 whose output controls a relay RLY. During correct operation of the timing circuit, the voltages on the outputs O/P2 and O/P4 will never be high at the same time, so that the output of the NAND gate will be high and the contacts of the relay RLY will be held in the position shown in FIG. 9. If, however, O/P2 and OP/4 should both become high at the same time, the output of the NAND gate will go low de-energising the relay RLY and resetting the timer T1 by sending a negative pulse to the reset input RST causing the voltage on the output O/P1 of the timer T1 to go high. The RLY common contact can also be connected to the TX modulator 48 to turn off transmission of the set signal to the de-modulator 53 anad to the master device MPU 80 to keep the point P high.

Because in this embodiment the "turn to GO" and "turn to STOP" commands are given by the transistor output of the board 54 going low and high respectively at the times t1 and t2 for one device and at times t3 and t4 for the other device, it is evident that any temporary interruption of the radio transmission between the timer and a device 10 during the period T1 to T2 or t3 to t4 may cause the device to behave erratically. Therefore, the circuit shown in FIG. 11 may be used to mitigate this problem.

The output O/P from the board 54 is available in inverted form. The inverted signal is connected to the trigger TR of a 555 timer 120. The output O/P of the timer 120 is connected to the base of a transistor 121 which turns on for a constant time after the trigger signal goes low. The time constant of the timer 120 is set to a time greater than that required to turn to the sign from 'STOP' to 'GO' and vice versa. The output from the board 54 is connected to the collector of the transistor 121 and further to point P on the MPU 80. Thus, when either the output from the board 54 or the output of the timer 120 are active low or high respectively the point P will be held low and the sign 16 will turn and remain in the 'GO' position.

Thus, if transmission of the 'turn to GO' signal to a device 10 is interrupted for a period less than the time constant of the 555 timer 120, the sign 16 will remain in the 'GO' position. The timing diagram shows such an interruption 123 in the 'turn to GO' signal, with the O/P signal going high. This causes a negative going edge on O/P bar which triggers the timer, holding the point P low for the period of the interruption.

It will be seen that when the O/P signal goes high at the end of the 'turn to GO' period, O/P bar will again trigger the 555 timer 120 causing the point P to remain low for an extra period of time after transmission ceases. Thus, in FIG. 9, the time constant of the RC circuit R2,C2 has to be reduced and R3,C3 must be increased to compensate for the effect of the 555 timer 120 and similarly for R4,C4 and R1,C1 if required.

In a variation of the second embodiment the automatic timer may be built into one of the devices 10, herein referred to as the master device, and directly control it. In such case the other device 10, herein referred to as the slave device, is controlled by radio from the master device.

To this end the output from the timer T2 is inverted in an inverter 110. This provides a negative-going pulse whose leading and trailing edges, occurring at times t1 and t2 respectively, can be detected by the MPU 80 in the same manner as previously described for the output of the latch 64. Thus the motor control circuit of the maser device is direct controlled.

The slave device is controlled by radio in the manner previously described, except since it is now only necessary to transmit during the period t3 to t4 the decoder is adapted to connect the Tx modulator 48 to ground only during such period.

The first embodiment could also be modified to provide direct control of one of the devices 10 by the handset 11.

Figure 12:
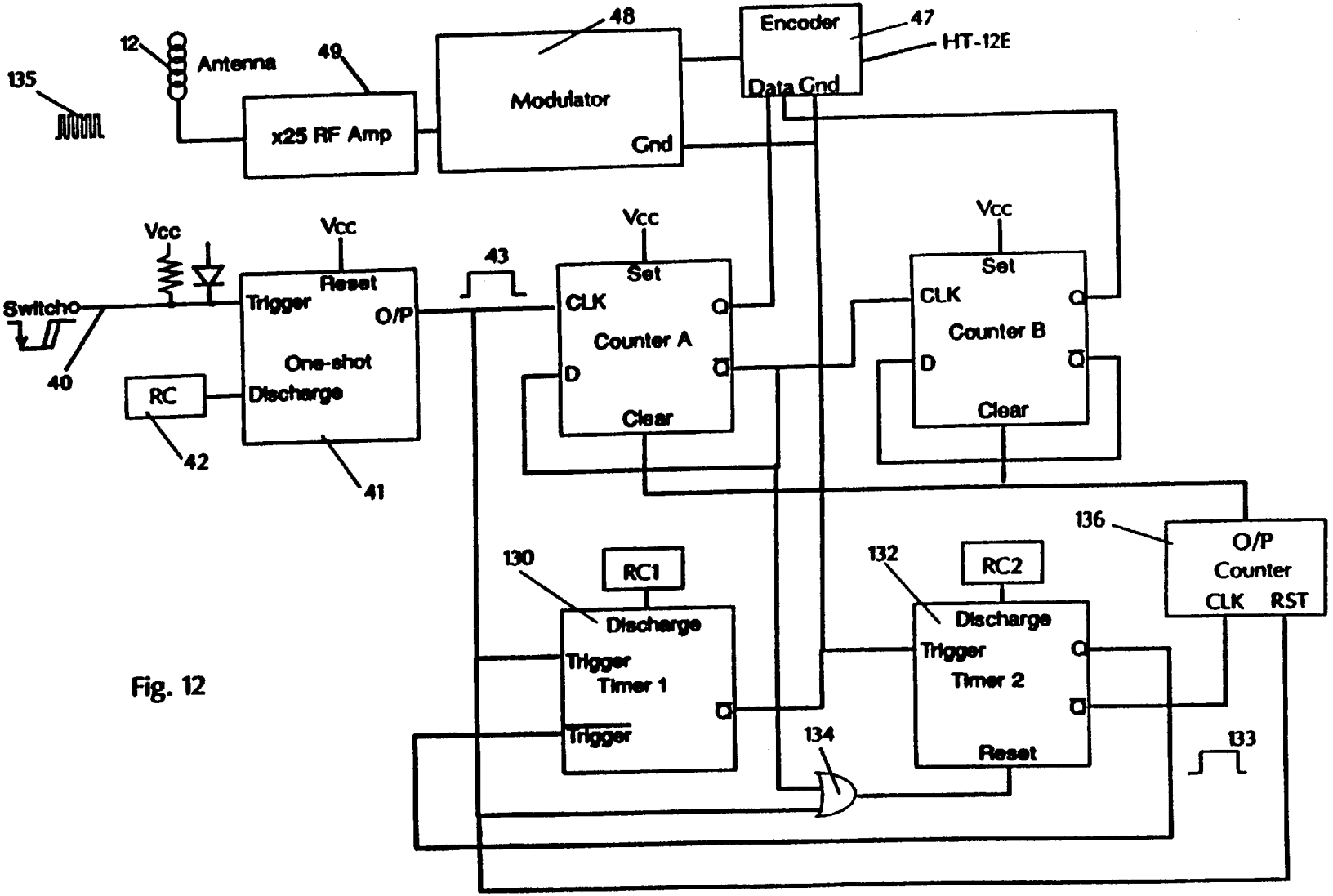
FIG. 12 is a block diagram of the internal transmitter circuitry of the handset in a third embodiment of the invention.
Figure 13:
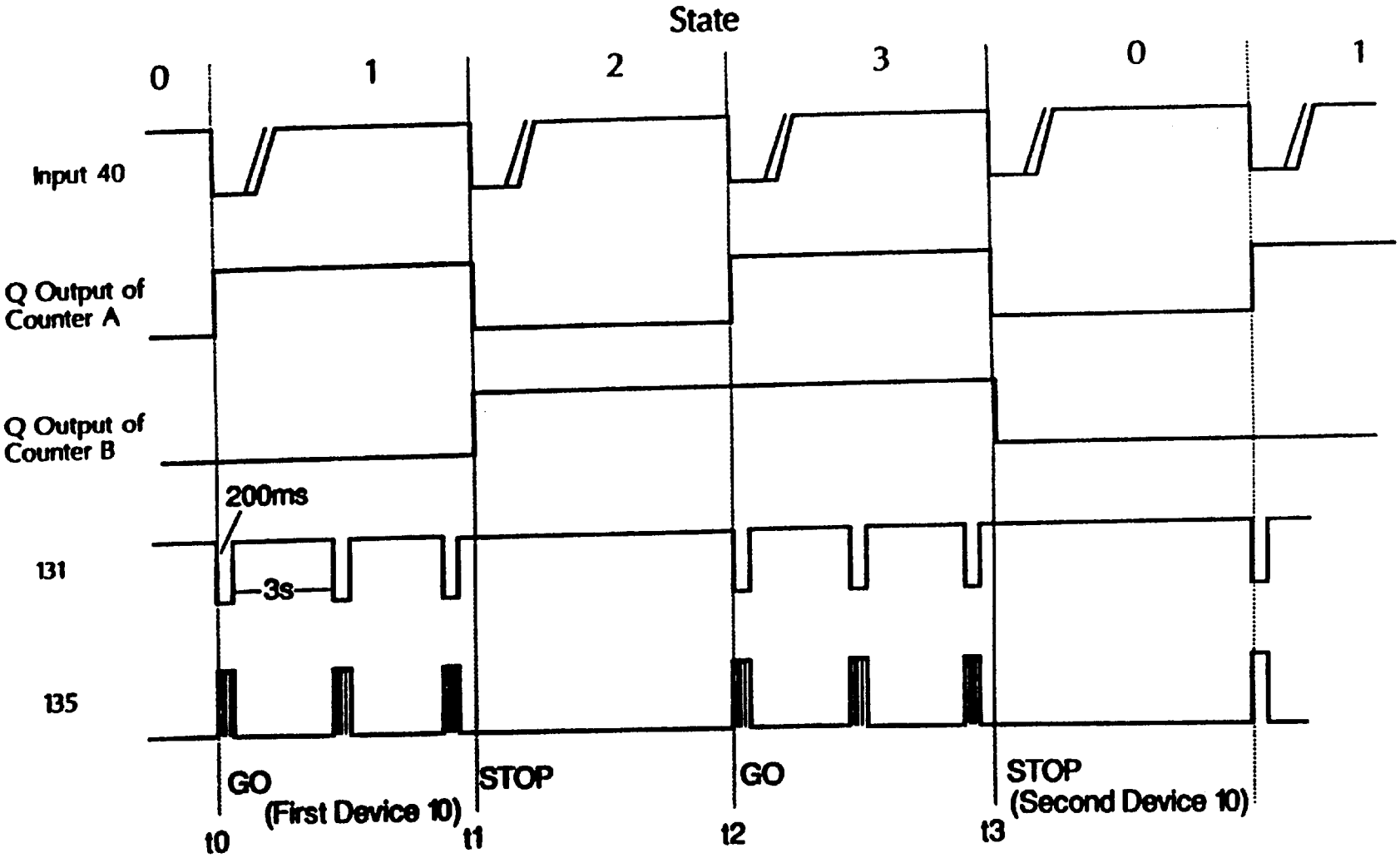
FIG. 13 is a timing diagram illustrating the operation of the circuitry of FIG. 12.

A third embodiment of the invention will now be described with reference to FIGS. 12 and 13. In this embodiment the mechanical aspects of the device are as described above, and the differences are in the control circuitry in the handset 11 and in the devices 10. In FIGS. 12 and 13 the same references have been used for components which are the same or equivalent to components in FIGS. 4 and 5.

Referring to FIG. 12, when the control button 17 is pressed by an operator at time t0 (FIG. 13), the input 40 of the control circuit is grounded, providing a negative-going edge at the trigger input of a one-shot multi-vibrator 41. This causes the output O/P of the latter to go high for a period determined by the resistor/capacitor combination 42 and thereby generate a positive-going pulse 43 at its output O/P. However, in contrast to the circuit of FIG. 4, in this embodiment the period of each pulse 43 is very short, in particular shorter than the duration of pulses generated by a timer 130 to be described, for example 66 ms.

The pulse 43 is applied to the clock input CLK of a counter A. The counter A is positive-edge triggered, so that the leading edge of the pulse 43 causes the Q output of the counter A to go high and correspondingly the Q bar output to go low. The Q bar output of the counter A is connected to the clock input of a second counter B, but since the counter B is also positive-edge triggered the negative-going edge at the Q bar output of the counter A does not change the state of the counter B.

The counters remain in state 1 (FIG. 13) until the next time the button 17 is pressed, at time t1, whereupon the leading edge of the corresponding pulse 43 causes the Q output of the counter A to go low and correspondingly the Q bar output to go high. The positive-going edge at the Q bar output of the counter A therefore changes the state of the counter B. At this point the counters are in state 2.

The next pulse 43, occurring on the third push of the button 17 at time t2, causes the Q output of the counter A to go high and the Q bar output to go low; however, the latter does not change the state of the counter B. The counters are now in state 3 shown in FIG. 13.

A fourth push of the button 17, at time t3, causes the Q output of the counter A to go low again and the Q bar output to go high, and the latter changes the state of the counter B. Thus the counters are returned to state 0 prevailing immediately prior to the first push of the button 17 and thereafter the cycle described above repeats for further pushes of the button 17 so that the counters A and B will cycle repeatedly through states 1, 2, 3, 0 so long as the button 17 is operated.

The Q outputs of the two counters A and B are applied in parallel to the inputs of a two-bit analog to digital (A–D) converter 47. This may be a Motorola A–D converter of type HT-12E. The output of the A–D converter 47 is an analog signal whose amplitude is proportional to the binary value of the 2-bit input, and will be different for each state 0–3 of the counters.

The analog signal is applied as input to a transmission (Tx) modulator 48 having the same construction as described for FIG. 4. Thus the output of the Tx modulator 48 is a 418 MHz frequency-modulated (FM) signal wherein the degree or depth of modulation at any instant is proportional to the amplitude of the analog signal from the A–D converter 47.

As in the case of the circuit of FIG. 4, the Tx modulator 48 is not in continuous operation. However, in the case of FIG. 4 the duration of the FM bursts was determined by the pulses 43; in the present case they are controlled by the Q bar output of a positive-edge triggered timer 130.

As well as being connected to the clock input of the counter A, the output of the one shot 41 is also connected to the trigger input of the timer 130, which may be implemented as a so-called 4548 timer chip. Thus, when the button 17 is pressed at time t0, the leading edge of the pulse 43 triggers the timer 130 so that its Q bar output goes low for a period determined by the time constant of the associated RC circuit RC1. This provides a negative-going pulse 131 at the Q bar output of the timer 130 having a duration of, in this embodiment, 200 ms.

The Q bar output of the timer 130 is connected to the trigger input of a second positive-edge triggered timer 132—thus the trailing (positive-going) edge of the pulse 131 causes the Q output of the timer 132 to go high for a period determined by the time constant of the associated RC circuit RC2. This provides a positive-going pulse 133 at the Q output of the timer 132 having a duration of, in this embodiment, 3 seconds.

The 3-second duration positive-going pulse 133 generated by the timer 132 is fed back to the inverted trigger input of the timer 130, thus holding the timer 130 off for 3 seconds. However, at the end of the three second period the trailing edge of the pulse 133 will again trigger the timer 130, so that a further 200 ms pulse 131 will be generated, and the trailing edge of this will in turn cause a 3-second pulse 133 to be generated by the timer 132. Thus, all throughout state 1 of the counters A and B, the Q bar output of the timer 130 will generate successive 200 ms pulses at 3 second intervals.

At t1, when the next pulse 43 is generated by a push on the handset button 17, the counters A and B enter state 2. The Q bar output of counter A is connected, via an OR gate 134, to the reset input of the timer 132. Thus when the counter A enters state 2 its Q bar output will go high to reset the timer 132 and hold it reset for the duration of state 2. Thus the timer 130 is not further triggered by pulse 133 from the timer 132 and thus no further 200 ms pulses 131 are generated by the timer 130 during state 2.

At time t2, however, the reset on timer 132 provided by the Q bar output of the counter A is removed, so that once again successive 200 ms pulses 131 are generated at 3 second intervals by the Q bar output of the timer 130, and these occur throughout state 3 of the counters A and B.

Finally, at time t3, the timer 132 is once again held reset by the Q bar output of the counter A, so that no further 200 ms pulses 131 are generated by the timer 130 during the following state 0. The above described pattern or cycle of pulses 131 then repeats as as the counters A and B cycle repeatedly through states 1, 2, 3, 0.

As indicated in FIG. 12, the ground terminal GND for both the Tx modulator 48 power supply and the A–D converter 47 power supply is connected to the Q bar output of the timer 130. This means that the ground terminals are only connected to circuit ground, and thus the TX modulator 48 only powered, during the occurrence of the negative-going pulses 131. The result is that each time we cycle through the four states 1, 2, 3, 0 of the counters A and B as previously described, the Tx modulator outputs successive 200 ms bursts 135 at 3-second intervals during states 1 and 3, but not during states 0 and 2. As mentioned before, the degree or depth of modulation of the bursts 135 is proportional to the amplitude of the analog signal from the A–D converter 47, so that the bursts occurring during state 1 will be differently modulated to those occurring during state 3. This provides a basis for controlling the two devices 10, as will now be described.

As indicated in FIG. 13, receipt of the first burst 135 during state 1 by a first of the devices 10 turns that device to the GO position Provided that following the initial burst subsequent bursts are received by the device 10 each of which follows the preceding burst by no longer than a predetermined period (longer than 3 seconds) and is at the correct modulation depth for control of that device, the first device 10 is maintained in the GO position. However, if the burst 135 are no longer received by the device 10 or the interval between them becomes longer than the predetermined period or the modulation depth is not correct for that device, that will be considered to be a command for the first device 10 to turn to the STOP position. This can occur by pushing the handset button 17 so that the counters A and B enter state 2, whereby the generation of pulses 131 and hence of bursts 135 ceases intentionally. However, it can also occur if there is power or other failure at the handset 11, or if the device 10 becomes out of range because of intervening traffic or other obstruction or interference, and therefore provides a safety feature.

It can also occur, however, through the action of a counter 136 which counts the pulses generated at the Q bar output of the timer 132, which are the inversion of the pulses 133. When a pre-determined number of pulses are counted after the handset button 17 is pressed the counter 136 clears the counters A and B (state 0), thereby automatically re-setting each device 10 to the STOP position. This occurs even though the Q bar output of the timer 130 is still outputting 200 ms pulses 131 because the modulation depth of the transmitted pulses, as determined by the A–D converter 47, no longer corresponds to that device. This serves an additional safety feature. The counter 136 is reset next time the handset button 17 is pressed. The output of the counter 136 could alternatively or additionally be fed back to the timer 130 to hold the latter off and thereby stop the pluses 131 until the next time the handset button is pushed.

Similarly, receipt of the first burst 135 during state 3 by the second of the devices 10 turns that device to the GO position and again provided that following the initial burst subsequent bursts are received by the device 10 each of which has the correct modulation depth for that device and follows the preceding burst by no longer than a predetermined period (longer than 3 seconds), the second device 10 is maintained in the GO position. However, if the bursts 135 are no longer received by the device 10 or the interval between them becomes longer than the predetermined period, that will be considered to be a command for the second deice 10 to turn to the STOP position.

Figure 11:
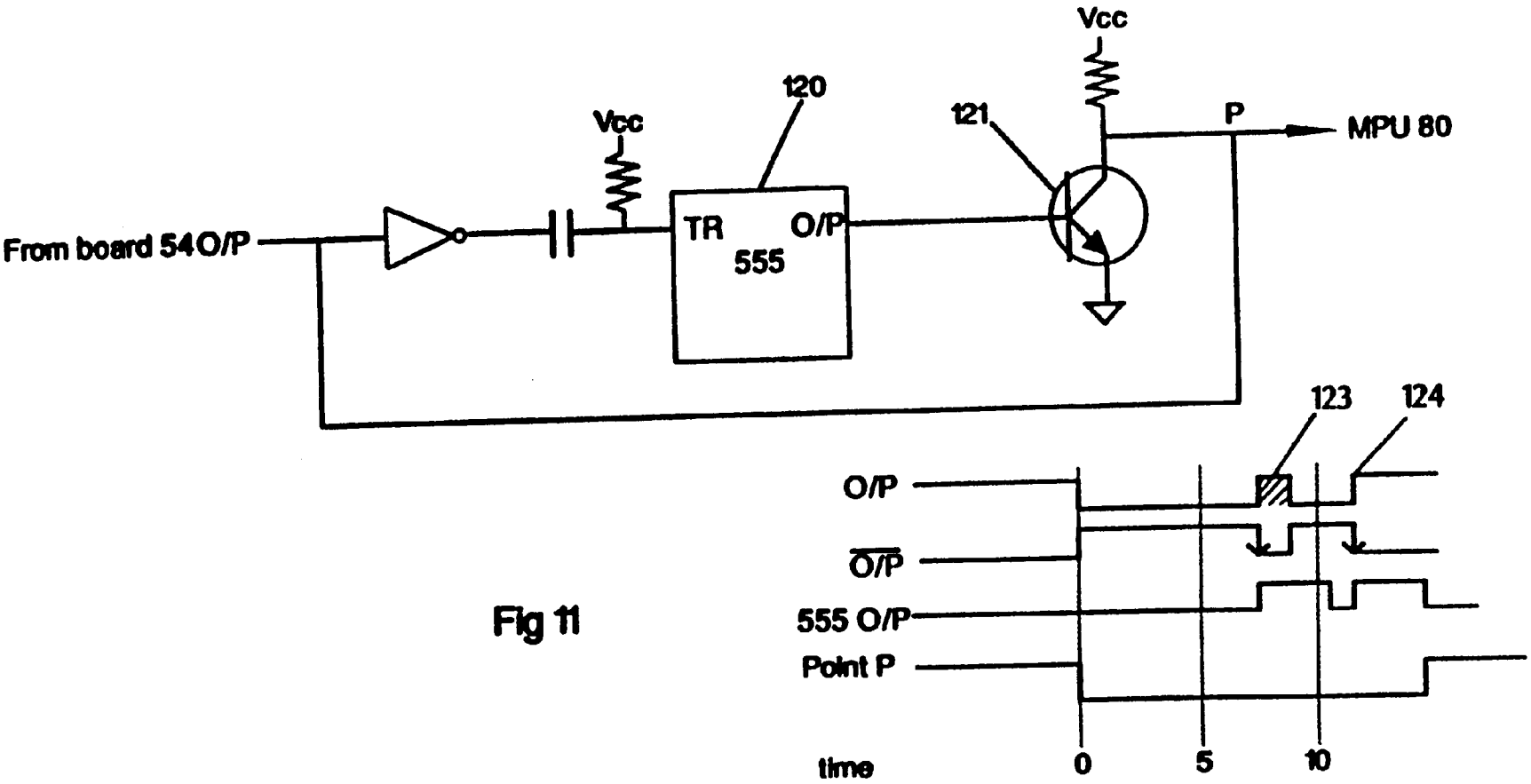
FIG. 11 is a circuit for mitigating the effect of interruptions in the radio signal in the second embodiment of the invention.

This function can be provided by the intelligent decoder 54 in a similar manner to its operation in the automatic timer embodiment described with reference to FIGS. 9 to 11. It will be recalled in that case that the output of the automatic timer was an FM signal consisting of successive signal periods separated by non-signal periods with the depth of modulation of the signal during the signal periods alternating between two values from one signal period to the next. Further it will be recalled that the start and end of each FM signal period having one depth of modulation constituted "turn to GO" and "turn to STOP" commands for a first of the devices 10, and the start and end of each FM signal period having the other depth of modulation constituted "turn to GO" and "turn to STOP" commands for the second of the devices 10.

It will be recognised that this is very similar to the present embodiment, except that in the present embodiment the alternate signal periods whose start and ends define the "turn to GO" and "turn to STOP" commands are trains of pulses rather than a continuous signal. Thus, whereas in FIG. 10 it was the start and end of the continuous signals during the periods t1 to t2 and t3 to t4 that defined the "turn to GO" and "turn to STOP" commands for the two devices, in this embodiment it is the pulse trains occurring during the periods t0 to t1 and t2 to t3.

Thus, by providing suitable integration or timing circuitry in the intelligent decoder 54, it is possible to derive therefrom the appropriate signals for monitoring by the MPU 80 to control the motor in each device 10.

Of course, the second embodiment could also be modified to use trains of pulses rather than continuous signals during the periods t1 to t2 and t3 to t4 if desired.

In the foregoing embodiments the sign 16 has two opposite sides and rotates through successive 180 degree angles to present the opposite sides of the sign to oncoming vehicles. However, such two-sided signs have a disadvantage in that when both signs are visible to the driver one may say STOP and the other GO. This can be overcome by making the sign with three or more sides, with STOP and GO indications on non-opposite sides. In such a case the reed switches 31 and 32 are located at such positions that the sign rotates back and forth through the angle, less than 180 degrees, necessary to bring the STOP and GO sides of the sign alternately face-on to the oncoming traffic. For example, in the case of a three-sided sign, the reed switches would be placed so as to provide a 120 degree rotation each time the sign turns.

Further, although the sign described above uses the English words GO and STOP, respectively on green and red backgrounds, as the GO and STOP indications, for the GO indication one could alternatively use the word "GO" in another language (where the sign is designed for use in a country using that language) and/or a green colour and/or any other symbol, word or colour which is generally recognised as permitting oncoming traffic to pass. Similarly, the STOP indication could be the word "STOP" in any other language and/or a red colour and/or any other symbol, word or colour which is generally recognised as requiring oncoming traffic to stop.

For example, instead of the word "STOP", the STOP indication could be a light box mounted on the surface of the panel 16 and having three lenses arranged vertically one above the other to visually emulate a conventional red/amber/green traffic light. However, only the red (top) lens would have a lamp behind it, and furthermore this lamp would preferably be lit only when the corresponding surface of the panel was turned to face oncoming traffic, i.e. turned to the STOP position, but would otherwise remain unlit. A similar arrangement could be used for the GO side of the panel 16, with a lamp only behind the green (bottom) lens which is only lit when the sign is in the GO position.

As a further development, either such light box could be mounted, facing in the appropriate direction, on the post 15 above the panel 16 rather than on the panel itself. Further, when both the GO and STOP indications are embodied as a light box, a single light box can be used having three vertically arranged lenses on each opposite side with the red (top) lens being active on one side and the green (bottom) lens active on the other, as described above. In such case the panel 16 could be dispensed with.

We claim:

1. A traffic control apparatus including a traffic control device (10) comprising a base (14), a sign (16) rotatably carried by the base and having at least two sides, one side bearing a "GO" indication and another side bearing a "STOP" indication, and a motor (27) on the base (14) coupled to the sign (16) for rotating the latter, the apparatus further including radio control means (11) for causing the motor (27) to position the sign (16) with the said one side and the said other side alternately in substantially the same angular position relative to the base (14), wherein the radio control means (11) includes a radio transmitter (FIG. 12) adapted to issue successive trains of radio frequency bursts (135, FIG. 13) to the device (10) and a radio receiver (FIG. 5) in the device (10) which is responsive to the start of a train of bursts (135) received from the transmitter to cause the motor (27) to rotate the sign (16) to bring the "GO" indication to the said angular position and responsive to the end of the train of bursts (135) received from the transmitter to cause the motor (27) to rotate the sign (16) to bring the side bearing the "STOP" indication substantially to the said angular position.

2. A traffic control apparatus including a plurality n of traffic control devices (10) as claimed in claim 1 and a common radio transmitter (FIG. 12) adapted to issue successive trains of bursts (135) to the devices, the trains of bursts (135) being modulated on a cyclical basis such that in each cycle of n bursts each train of bursts is differently modulated, each traffic control device (10) being responsive to a responsive one of the differently modulated trains of bursts in each cycle.

3. A traffic control apparatus as claimed in claim 2, wherein the radio transmitter (FIG. 12) has a counter circuit (Counter A, Counter B) which cycles through 2n states in response to consecutive input signals (43), a pulse generating circuit (130, 132) for generating a pulse train (131) during each alternate state of the counter circuit, and a transmission modulator (48) responsive to the pulse generating circuit and the state of the counter circuit for generating the said trains of bursts (135).

4. A traffic control apparatus as claimed in claim 3, wherein the transmission modulator (48) is battery powered, wherein battery power is supplied to the transmission modulator (48) under the control of the pulse generating circuit (130, 132) substantially only during the occurrence of each pulse generated by the pulse generating circuit thereby to generate the trains of bursts (135), and wherein the depth of modulation of each burst is determined by the current state of the counter circuit (Counter A, Counter B).

5. A traffic control apparatus according to claim 4, wherein the radio transmitter (11) is a manually operable hand-held device having a manual actuation element (17) for providing the input signals to the counter circuit (Counter A, Counter B).

6. A traffic control apparatus according to claim 3, wherein the radio transmitter (11) is a manually operable hand-held device having a manual actuation element (17) for providing the input signals to the counter circuit (Counter A, Counter B).

* * * * *